US011056056B2

(12) United States Patent
Xuan et al.

(10) Patent No.: US 11,056,056 B2
(45) Date of Patent: Jul. 6, 2021

(54) PIXEL UNIT CIRCUIT, METHOD OF DRIVING THE SAME, PIXEL CIRCUIT AND DISPLAY DEVICE

(71) Applicant: BOE TECHNOLOGY GROUP CO., LTD., Beijing (CN)

(72) Inventors: Minghua Xuan, Beijing (CN); Xiaochuan Chen, Beijing (CN); Shengji Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/622,719

(22) PCT Filed: Aug. 2, 2018

(86) PCT No.: PCT/CN2018/098256
§ 371 (c)(1),
(2) Date: Dec. 13, 2019

(87) PCT Pub. No.: WO2019/024887
PCT Pub. Date: Feb. 7, 2019

(65) Prior Publication Data

US 2020/0105196 A1 Apr. 2, 2020

(30) Foreign Application Priority Data

Aug. 3, 2017 (CN) ..... 201710655886.7

(51) Int. Cl.
*G09G 3/3241* (2016.01)
*G09G 3/3291* (2016.01)

(52) U.S. Cl.
CPC ..... *G09G 3/3241* (2013.01); *G09G 3/3291* (2013.01); *G09G 2300/0842* (2013.01)

(58) Field of Classification Search
CPC ..... G09G 3/3241; G09G 3/3291; G09G 2300/0842; G09G 2320/0233;
(Continued)

(56) References Cited

U.S. PATENT DOCUMENTS

2007/0035484 A1* 2/2007 Chang ..... G09G 3/3233 345/76
2010/0225623 A1* 9/2010 Ohhashi ..... G09G 3/3233 345/205
(Continued)

FOREIGN PATENT DOCUMENTS

CN 1547183 A 11/2004
CN 1767202 A 5/2006
(Continued)

OTHER PUBLICATIONS

First Office Action for Chinese Application No. 201710655886.7, dated Feb. 2, 2019, 11 Pages.
(Continued)

*Primary Examiner* — Temesghen Ghebretinsae
*Assistant Examiner* — Ivelisse Martinez Quiles
(74) *Attorney, Agent, or Firm* — Brooks Kushman P.C.

(57) ABSTRACT

A pixel unit circuit, a method of driving the same, a pixel circuit and a display device are provided. A pixel unit circuit includes a light-emitting component, a driving transistor, a data writing circuit and a storage capacitor circuit. The data writing circuit is coupled to a data line, a gate line and a gate electrode of the driving transistor, and configured to, under a control of the gate line, enable a connection between the data line and the gate electrode of the driving transistor to be turned on or off. A first end of the storage capacitor circuit is coupled to the gate electrode of the driving transistor, and a second end of the storage capacitor circuit is coupled to a
(Continued)

reference voltage input terminal. A second end of the light-emitting component is coupled to a low-level input terminal.

2 Claims, 6 Drawing Sheets

(58) Field of Classification Search
CPC ..... G09G 2310/0251; G09G 3/3233; G09G 2320/0626; G09G 3/3258
See application file for complete search history.

(56) References Cited

U.S. PATENT DOCUMENTS

| | | | | |
|---|---|---|---|---|
| 2011/0074758 | A1* | 3/2011 | Wacyk | G09G 3/3258 345/211 |
| 2015/0213756 | A1 | 7/2015 | Wacyk | |
| 2015/0302799 | A1* | 10/2015 | Feng | G09G 3/3233 345/76 |
| 2016/0042694 | A1* | 2/2016 | Lim | G09G 3/3233 345/78 |
| 2018/0190185 | A1 | 7/2018 | Ko et al. | |
| 2019/0197957 | A1* | 6/2019 | Miura | H01L 27/3276 |
| 2020/0105196 | A1 | 4/2020 | Xuan et al. | |

FOREIGN PATENT DOCUMENTS

| | | | |
|---|---|---|---|
| CN | 102789761 | A | 11/2012 |
| CN | 203433775 | U | 2/2014 |
| CN | 103927984 | A | 7/2014 |
| CN | 103971636 | A | 8/2014 |
| CN | 104217674 | A | 12/2014 |
| CN | 105679236 | A | 6/2016 |
| CN | 107424569 | A | 12/2017 |

OTHER PUBLICATIONS

International Search Report and Written Opinion for Application No. PCT/CN2018/098256, dated Oct. 12, 2018, 12 Pages.

* cited by examiner

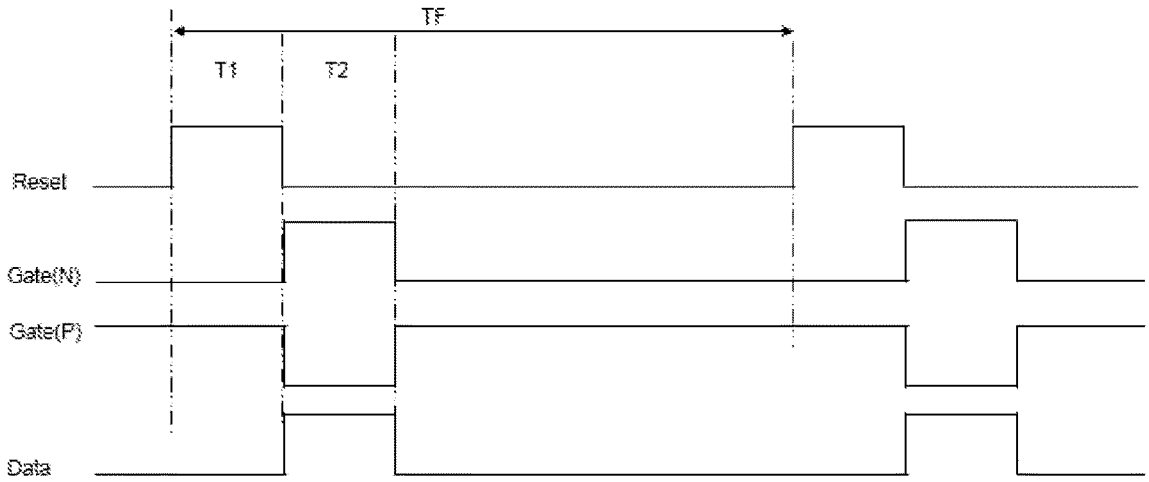

Fig. 4 in each display period, in a light-emitting phase, under a control of the gate line, enabling by the data writing circuit a connection between the data line and the gate electrode of the driving transistor to be turned on, to enable the driving transistor to work in a constant-current region to drive the light-emitting component to emit light, where a source electrode voltage of the driving transistor varies with a gate electrode potential of the driving transistor

1

Fig. 5

PIXEL UNIT CIRCUIT, METHOD OF DRIVING THE SAME, PIXEL CIRCUIT AND DISPLAY DEVICE

CROSS-REFERENCE TO RELATED APPLICATIONS

This application is the U.S. national phase of PCT Application No. PCT/CN2018/098256 filed on Aug. 2, 2018, which claims priority to Chinese Patent Application No. 201710655886.7 filed on Aug. 3, 2017, which are incorporated herein by reference in their entireties.

TECHNICAL FIELD

The present disclosure relates to the field of display technologies, and in particular, to a pixel unit circuit, a method of driving the same, a pixel circuit and a display device.

BACKGROUND

The luminance of a silicon-based OLED (Organic Light-Emitting Diode) is usually controlled by driving a current in a subthreshold region of a MOS transistor (metal-oxide-semiconductor field effect transistor). Since the current of the MOS transistor is proportional to its width-to-length ratio, in order to realize the small current of the micro display pixel, the ratio of the W/L (width to length ratio) must be designed to be very small, that is, the length L of the driving MOS transistor must be designed to be very large. As a result, it is very difficult to apply to high-resolution products. The storage capacitor cannot be made large, and the data voltage cannot be stably maintained, resulting in unstable OLED brightness. The subthreshold current of the MOS transistor is sensitive to the gate-source voltage and the threshold voltage, and the peripheral circuit is very complicated, In general, the silicon-based pixel circuit (using a control MOS transistor operating at a subthreshold) is difficult to reduce the area of the driving MOS transistor, so it is difficult to be applied to ultra-high resolution products. The current is sensitive to the gate-source voltage and threshold voltage of the control MOS transistor, and the peripheral circuit is relatively complicated.

SUMMARY

A pixel unit circuit is provided in the present disclosure, including a light-emitting component, a driving transistor, a data writing circuit and a storage capacitor circuit, where a drain electrode of the driving transistor is coupled to a high-level input terminal, a source electrode of the driving transistor is coupled to a first end of the light-emitting component, the driving transistor is an n-type transistor;

the data writing circuit is coupled to a data line, a gate line and a gate electrode of the driving transistor, and configured to, under a control of the gate line, enable a connection between the data line and the gate electrode of the driving transistor to be turned on or off;

a first end of the storage capacitor circuit is coupled to the gate electrode of the driving transistor, and a second end of the storage capacitor circuit is coupled to a reference voltage input terminal;

a second end of the light-emitting component is coupled to a low-level input terminal.

Optionally, the pixel unit circuit further includes a reset circuit, where the reset circuit is coupled to a reset terminal, the reference voltage input terminal and the gate electrode of the driving transistor, and configured to, under a control of the reset terminal, enable a connection between the gate electrode of the driving transistor and the reference voltage input terminal to be turned on or off.

Optionally, the reset circuit includes a reset transistor, a gate electrode of the reset transistor is coupled to the reset terminal, a first electrode of the reset transistor is coupled to the gate electrode of the driving transistor, a second electrode of the reset transistor is coupled to the reference voltage input terminal, the reset transistor is an n-type transistor or a p-type transistor.

Optionally, the gate line includes a first gate line and a second gate line;

the data writing circuit includes:

a first data writing transistor, where a gate electrode of the first data writing transistor is coupled to the first gate line, a first electrode of the first data writing transistor is coupled to the data line, a second electrode of the first data writing transistor is coupled to the gate electrode of the driving transistor; and a second data writing transistor, where a gate electrode of the second data writing transistor is coupled to the second gate line, a first electrode of the second data writing transistor is coupled to the gate electrode of the driving transistor, a second electrode of the second data writing transistor is coupled to the data line;

the first data writing transistor is an n-type transistor, and the second data writing transistor is a p-type transistor.

Optionally, an absolute value of a threshold voltage of the first data writing transistor is equal to an absolute value of a threshold voltage of the second data writing transistor.

Optionally, the storage capacitor circuit includes a storage capacitor, where a first end of the storage capacitor is coupled to the gate electrode of the driving transistor and a second end of the storage capacitor is coupled to the reference voltage input terminal.

Optionally, the light-emitting component includes an organic light-emitting diode, a first end of the light-emitting component is an anode of the organic light-emitting diode, and a second end of the light-emitting component is a cathode of the organic light-emitting diode.

A method of driving the pixel unit circuit hereinabove is further provided in the present disclosure, including: in each display period, in a light-emitting phase, under a control of the gate line, enabling by the data writing circuit a connection between the data line and the gate electrode of the driving transistor to be turned on, to enable the driving transistor to work in a constant-current region to drive the light-emitting component to emit light, where a source electrode voltage of the driving transistor varies with a gate electrode potential of the driving transistor.

Optionally, each display period further includes a resetting phase, the method further includes:

in the resetting phase, under the control of the gate line, enabling by the data writing circuit the connection between the data line and the gate electrode of the driving transistor to be turned off; under a control of a reset terminal, enabling by a resetting circuit a connection between the gate electrode of the driving transistor and the reference voltage input terminal to be turned on;

in the light-emitting phase, under the control of the reset terminal, enabling by the resetting circuit the connection between the gate electrode of the driving transistor and the reference voltage input terminal to be turned off.

Optionally, the reference voltage input terminal is configured to input a reference voltage;

a difference between the reference voltage and a threshold voltage of the driving transistor is smaller than a sum value of a low level input by the low-level input terminal and a light-up voltage of the light-emitting component.

Optionally, the gate line includes a first gate line and a second gate line, and the data writing circuit includes: a first data writing transistor, where a gate electrode of the first data writing transistor is coupled to the first gate line; a second data writing transistor, where a gate electrode of the second data writing transistor is coupled to the second gate line; the first data writing transistor is an n-type transistor, and the second data writing transistor is a p-type transistor; and when an absolute value of a threshold voltage of the first data writing transistor is equal to an absolute value of a threshold voltage of the second data writing transistor, the enabling by the data writing circuit the connection between the data line and the gate electrode of the driving transistor to be turned off in the resetting phase under the control of the gate line, further includes:

outputting a first gate driving signal by the first gate line, and outputting a second gate driving signal by the second gate line, where a potential of the first gate driving signal is a low voltage and a potential of the second gate driving signal is a high voltage, to enable the first data writing transistor and the second data writing transistor to be turned off, and to enable the connection between the data line and the gate electrode of the driving transistor to be turned off;

the enabling by the data writing circuit the connection between the data line and the gate electrode of the driving transistor to be turned on in the light-emitting phase under the control of the gate line, includes:

outputting the first gate driving signal by the first gate line, and outputting the second gate driving signal by the second gate line, where the potential of the first gate driving signal is the high voltage and the potential of the second gate driving signal is the low voltage, to enable the first data writing transistor to be turned on and enable the second data writing transistor to be turned on;

the method further includes: after the light-emitting phase ends in each display period, outputting the first gate driving signal by the first gate line, and outputting the second gate driving signal by the second gate line, where the potential of the first gate driving signal is the low voltage and the potential of the second gate driving signal is the high voltage, to enable the first data writing transistor and the second data writing transistor to be turned off, and to enable the connection between the data line and the gate electrode of the driving transistor to be turned off.

A pixel circuit is further provided in the present disclosure, including a plurality of rows of gate lines, a plurality of columns of data lines and a plurality of pixel unit circuits arranged in an array form hereinabove, where the pixel unit circuits in the same row are coupled to the gate lines in the same row, and the pixel unit circuits in the same column are coupled to the data lines in the same column.

Optionally, the gate lines include first gate lines and second gate lines, and the pixel unit circuits in the same row are each coupled to the first gate lines in the same row and the second gate lines in the same row.

A display device is further provided in the present disclosure, including a plurality of rows of gate lines, a plurality of columns of data lines and a plurality of pixel unit circuits arranged in an array form hereinabove, where the pixel unit circuits in the same row are coupled to the gate lines in the same row, and the pixel unit circuits in the same column are coupled to the data lines in the same column.

Optionally, the display device further includes a silicon substrate, where the plurality of rows of gate lines, the plurality of columns of data lines and the plurality of pixel unit circuits are arranged on the silicon substrate.

BRIEF DESCRIPTION OF THE DRAWINGS

FIG. 4 is a working sequence diagram of the pixel unit circuit shown in FIG. 2 of the present disclosure;

FIG. 5 is a flow chart of a method of driving a pixel unit circuit in some embodiments of the present disclosure;

DETAILED DESCRIPTION

The present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

The transistors in all embodiments of the present disclosure may each be a thin film transistor or a field-effect transistor or other devices having the same characteristics. In the embodiments of the present disclosure, in order to distinguish the two electrodes of the transistor except the gate electrode, one of the electrodes is referred to as a first electrode, and the other electrode is referred to as a second electrode. In the actual operation, the first electrode may be a drain electrode, and the second electrode may be a source electrode; or the first electrode may be a source electrode, and the second electrode may be a drain electrode.

Figure 1:
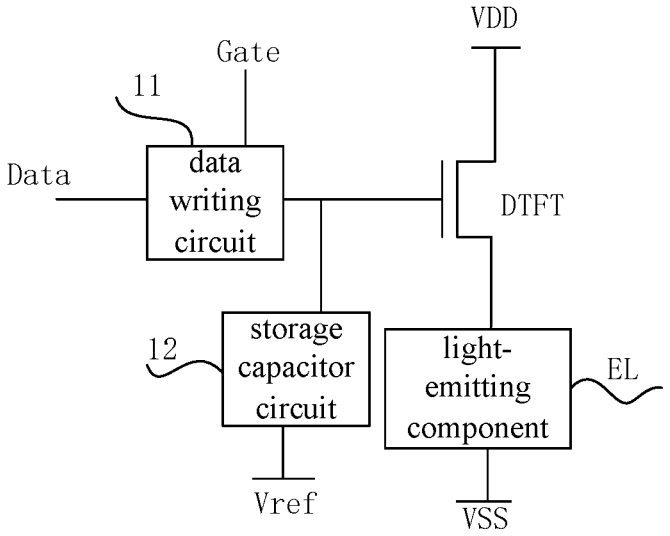
FIG. 1 is a schematic view of a pixel unit circuit in some embodiments of the present disclosure.

As shown in FIG. 1, a pixel unit circuit in some embodiments of the present disclosure includes a light-emitting component, a driving transistor, a data writing circuit and a storage capacitor circuit, where a drain electrode of the driving transistor DTFT is coupled to a high-level input terminal configured to input a high level VDD, a source electrode of the driving transistor DTFT is coupled to a first end of the light-emitting component EL, the driving transistor DTFT is an n-type transistor;

the data writing circuit 11 is coupled to a data line Data, a gate line Gate and a gate electrode of the driving transistor DTFT, and configured to, under a control of the gate line Gate, enable a connection between the data line Data and the gate electrode of the driving transistor DTFT to be turned on or off;

a first end of the storage capacitor circuit 12 is coupled to the gate electrode of the driving transistor DTFT, and a second end of the storage capacitor circuit 12 is coupled to a reference voltage input terminal configured to input a reference voltage Vref;

a second end of the light-emitting component EL is coupled to a low-level input terminal configured to input a low level VSS.

Specifically, the driving transistor may be an NMOS (N-Metal-Oxide-Semiconductor) tube.

According to the embodiments of the present disclosure, the pixel unit circuit, by utilizing a source electrode follow characteristic of an NMOS transistor (i.e., a driving transistor, a n-type driving transistor) at a constant current (that is, when the driving transistor operates in a constant-current region), changes the potential of the gate electrode of the driving transistor (that is, the potential of the data voltage outputted by the data line) to change the voltage of the source electrode of the driving transistor, and adjusts the illuminance of the light-emitting component by adjusting the voltage difference between the first end of the light-emitting component and the second end of the light-emitting component, thereby solving the following technical issues in the related art: the driving transistor driving the silicon-based OLED to emit light works in the subthreshold region, so the size of the driving transistor needs to be very large, so it cannot be applied to a high-resolution display product, and the size of the storage capacitor cannot be made large, resulting in a that the luminance of the light-emitting component is unstable due to the inability to stably maintain the data voltage.

Figure 2:
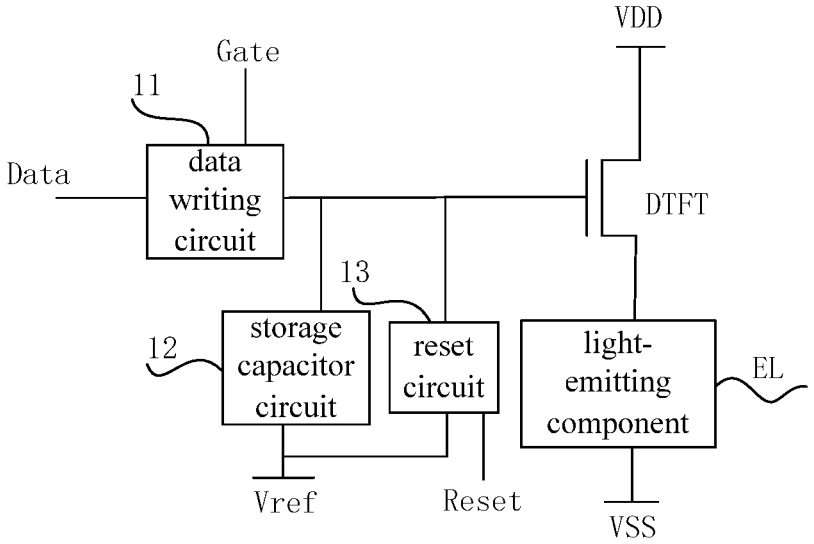
FIG. 2 is a schematic view of a pixel unit circuit in some embodiments of the present disclosure.

Optionally, as shown in FIG. 2, the pixel unit circuit in some embodiments of the present disclosure further includes a reset circuit 13;

The reset circuit 13 is coupled to a reset terminal Reset, the reference voltage input terminal configured to input the reference voltage Vref and the gate electrode of the driving transistor DTFT, and configured to, under a control of the reset terminal Reset, enable a connection between the gate electrode of the driving transistor DTFT and the reference voltage input terminal configured to input the reference voltage Vref to be turned on or off.

In some embodiments of the present disclosure, the pixel unit circuit may further include the reset circuit 13 to control the potentials of two ends of the storage capacitor circuit 12 to be equal in the resetting phase, thereby quickly discharging the storage capacitor circuit 12, ensuring that the image of the previous frame does not affect the image of the next frame. By adjusting the voltage value of Vref, the difference between the potential Vref−Vth of the first end of the light-emitting component and the potential VSS of the second end of the light-emitting component in the resetting phase may be smaller than the light-up voltage of the light-emitting component, so that the light-emitting components do not emit light during the resetting phase, and the dynamic image sticking may not occur in the dynamic picture.

Specifically, the reset circuit may include a reset transistor, a gate electrode of the reset transistor is coupled to the reset terminal, a first electrode of the reset transistor is coupled to the gate electrode of the driving transistor, a second electrode of the reset transistor is coupled to the reference voltage input terminal, the reset transistor is an n-type transistor or a p-type transistor.

Optionally, the gate line includes a first gate line and a second gate line;

The data writing circuit includes:

a first data writing transistor, where a gate electrode of the first data writing transistor is coupled to the first gate line, a first electrode of the first data writing transistor is coupled to the data line, a second electrode of the first data writing transistor is coupled to the gate electrode of the driving transistor; and a second data writing transistor, where a gate electrode of the second data writing transistor is coupled to the second gate line, a first electrode of the second data writing transistor is coupled to the gate electrode of the driving transistor, a second electrode of the second data writing transistor is coupled to the data line;

the first data writing transistor is an n-type transistor, and the second data writing transistor is a p-type transistor.

Optionally, the data writing circuit includes two data writing transistors of opposite types, thereby improving the loss of the transmitted data voltage due to using a single transistor while ensuring that the amplitude range in which the data voltage can be written becomes larger.

Optionally, an absolute value of a threshold voltage of the first data writing transistor is equal to an absolute value of a threshold voltage of the second data writing transistor.

Optionally, the first data writing transistor and the second data writing transistor adopt a TFT characteristic curve symmetrical transistor, that is, the absolute value of the threshold voltage of the first data writing transistor is equal to the absolute value of the threshold voltage of the second data writing transistor, thereby solving the glitch caused by the sudden jump of the gate driving signals of the two gate lines.

Specifically, the storage capacitor circuit may include a storage capacitor, where a first end of the storage capacitor is coupled to the gate electrode of the driving transistor and a second end of the storage capacitor is coupled to the reference voltage input terminal Specifically, the light-emitting component may include an organic light-emitting diode; an anode of the organic light-emitting diode is a first end of the light-emitting component, and a cathode of the organic light-emitting diode is a second end of the light-emitting component.

Figure 3:
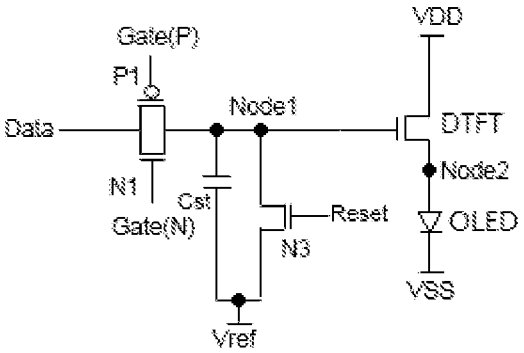
FIG. 3 is a circuit diagram of a pixel unit circuit in some embodiments of the present disclosure.

As shown in FIG. 3, the pixel unit circuit in some embodiments of the present disclosure includes: an organic light-emitting diode OLED, a driving transistor DTFT, a data writing circuit, a storage capacitor Cst and a resetting circuit 12, wherein a drain electrode of the driving transistor DTFT is coupled to a high-level input terminal configured to input a high level VDD, a source electrode of the driving transistor DTFT is coupled to an anode of the organic light-emitting diode OLED, the driving transistor DTFT is an n-type transistor;

a first end of the storage capacitor Cst is coupled to the gate electrode of the driving transistor DTFT, and a second end of the storage capacitor Cst is coupled to a reference voltage input terminal configured to input a reference voltage Vref;

a cathode of the organic light-emitting diode OLED is coupled to a low-level input terminal configured to input a low level VSS;

The reset circuit includes: a reset transistor N3, a gate electrode of the reset transistor N3 is coupled to the reset terminal Reset, a source electrode of the reset transistor N3 is coupled to the gate electrode of the driving transistor DTFT, and a drain electrode thereof is coupled to a reference voltage input terminal configured to input the reference voltage Vref;

The data writing circuit includes:

a first data writing transistor N1, where a gate electrode of the first data writing transistor N1 is coupled to the first gate line Gate (N), a drain electrode of the first data writing transistor N1 is coupled to the data line Data, a source electrode of the first data writing transistor N1 is coupled to the gate electrode of the driving transistor DTFT; and a second data writing transistor P1, where a gate electrode of the second data writing transistor P1 is coupled to the second gate line Gate (P), a drain electrode of the second data writing transistor P1 is coupled to the gate electrode of the driving transistor DTFT, a drain electrode of the second data writing transistor P1 is coupled to the data line Data;

The first data writing transistor N1 is an NMOS transistor, and the second data writing transistor P1 is a PMOS transistor.

In some embodiments of the present disclosure, N3 is an n-type transistor. In the actual operation, N3 may also be a p-type transistor, and the type of the reset transistor is not limited herein.

As shown in FIG. 3, in some embodiments of the present disclosure, Node 1 is a first node coupled to a gate electrode of the driving transistor DTFT, and Node 2 is a second node coupled to an anode of the organic light-emitting diode OLED.

As shown in FIG. 4, when the pixel unit circuit shown in FIG. 3 works, in one frame display time period TF, in the resetting phase T1, Reset outputs a high level, N3 is turned on, Node1 writes in Vref, and Cst is discharged (the potentials at both ends of Cst are Vref, which can quickly clear and discharge Cst), while the potential of Node2 becomes Vref−Vth, where Vth is the threshold voltage of the DTFT. At this time, Vref adopts a lower potential close to VSS in a silicon-based CMOS (Complementary Metal Oxide Semiconductor) process, so that a difference between the potential Vref−Vth of the anode of the OLED and the potential VSS of the cathode of the OLED is smaller than the light-up voltage of the OLED, so that the display screen is black and does not emit light during the resetting phase. At present, the light-up voltage of both a white light OLED or an OLED device in which each sub-pixel is separately illuminated are larger than 2V, so the voltage value of Vref may be determined according to the process of silicon-based CMOS and the specification of the product. In the resetting phase T1, Gate electrode (P) outputs a low voltage (for example, 0V), and Gate electrode (N) outputs a high voltage (for example, 5V), so that both N1 and P1 are turned off.

In the lighting phase T2, Gate electrode (P) outputs a high voltage (for example, 5V), Gate electrode (N) outputs a low voltage (for example, 0V), N1 and P1 are simultaneously turned on, and the data voltage Vdata on Data is charged to Node1 and stored into Cst. At this time, DTFT works in the constant-current region, using the source electrode follow characteristic of the NMOS transistor (i.e., DTFT) in the constant current state, the voltage of Node2 is Vdata−Vth. The voltage value of Vdata is changed to change the voltage of the Node2, so as to change the voltage difference between the anode of the OLED and the cathode of the OLED to change the light-emitting luminance of the OLED.

After the illumination phase T2 ends, Gate electrode (P) outputs a low voltage (e.g., may be 0V), and Gate electrode (N) outputs a high voltage (e.g., may be 5V), such that both N1 and P1 are turned off.

As shown in FIG. 4, in the actual operation, the absolute value of the differential pressure of the rising edge of Gate electrode (N) may be set to be equal to the absolute value of the differential pressure of the falling edge of Gate electrode (P) at this time, and the absolute value of the differential pressure of the falling edge Gate electrode (N) is set to be equal to the absolute value of the differential pressure of the rising edge of Gate electrode (P) at this time, so as to counteract the glitch of the voltage of the anode of the OLED when the data writing circuit adopts a single transistor.

Optionally, in order to counteract the glitch of the pull-up and pull-down of the written data caused by Gate electrode (N) and Gate electrode (P), it is necessary to set the absolute value of the differential pressure of the rising edge of Gate electrode (N) to be equal to the absolute value of the differential pressure at the falling edge of Gate electrode (P) at this time, and the absolute value of the differential pressure at the falling edge of Gate electrode (N) is set to be equal to the absolute value of the differential pressure at the rising edge of Gate electrode (P) at this time.

Specifically, when the voltage value range of the data voltage changes, the voltage value of the high voltage and the voltage value of the low voltage may also change accordingly.

The data writing circuit uses dual transistors (P1 and N1) for the purpose of increasing the voltage range of Node1, which is equivalent to increasing the voltage range of Node2, and finally increasing the adjustable voltage range of the light-emitting of the OLED device. The voltage transmitted through P1 (P1 is a PMOS transistor) to Node1 is at relatively high level. When Vgsp<Vthp, P1 is in the on-state (Vgsp is the gate electrode-source electrode voltage of P1, Vthp is the threshold voltage of P1), Vgsp=Vgate (P)−Vdata), Vgate (P) is the voltage output by Gate (P). When Vgsp>Vthp, P1 is in a non-conducting state, that is, when Vdata<Vgate(P)−Vthp, Vdata cannot be transmitted to Note1 through the conductive P1. The voltage transmitted through N1 (N1 is a NMOS transistor) to Node1 is at a relatively low level. When Vgsn>Vthn, N1 is in an on-state (Vgsn is the gate electrode-source electrode voltage of N1, Vthn is the threshold voltage of N1), Vgsn=Vgate (N)−Vdata, Vgate (N) is the voltage output by Gate electrode (N). When Vgsn<Vthn, N1 is in a non-conducting state, that is, when Vdata>Vgate(N)−Vthn, Vdata cannot be transmitted to Node1 through conductive N1.

P1 and N1 are transistors with symmetric characteristics of TFT (Thin Film Transistor), that is, Vthp=−Vthn, and the double transistor is adopted as the switch transistor for transmitting the data voltage Vdata to Node1, thereby reducing the noise. At the beginning of light-emitting phase T2, the rising edge of the voltage outputted by Gate electrode (N) will raise the potential of Node1, thereby raising the potential of Node2, that is, if the data writing circuit includes only N1, at the beginning of the light-emitting phase T2 (That is, when Vdata is just in the beginning to input, the potential of the anode of the OLED will appear as a rising glitch corresponding to the rising edge of the voltage output by Gate electrode (N). At the end of the light-emitting phase T2, the voltage output of Gate electrode (N) is at the falling edge and will pull down the potential of Node1, thus lowering the potential of Noed1, that is, if the data writing circuit includes only N1, when the light-emitting phase T2 ends, the anode potential of the OLED will appear a falling glitch corresponding to the falling edge of the voltage output by Gate electrode (N). The waveform of the voltage output by Gate electrode (P) is opposite to the waveform of the voltage output by Gate electrode (N). At the beginning of the light-emitting phase T2, the voltage output of Gate electrode (P) is declining, and the voltage of the anode of the OLED will appear a falling glitch. At the end of the illuminating phase T2, the voltage output of the Gate electrode (P) is at the rising edge, and the voltage of the anode of the OLED will appear a rising glitch. The double transistor (N1 and P1) may counteract the glitch caused when using the single transistor.

A method of driving the pixel unit circuit hereinabove is further provided in some embodiments of the present disclosure. As shown in FIG. 5, the method includes:

Step 1: in each display period, in a light-emitting phase, under a control of the gate line, enabling by the data writing circuit a connection between the data line and the gate electrode of the driving transistor to be turned on, to enable the driving transistor to work in a constant-current region to drive the light-emitting component to emit light, where a source electrode voltage of the driving transistor varies with a gate electrode potential of the driving transistor.

According to method of driving the pixel unit circuit in some embodiments of the present disclosure, the potential of the gate electrode of the driving transistor (that is, the potential of the data voltage outputted by the data line) is changed to change the voltage of the source electrode of the driving transistor, and the illuminance of the light-emitting component is adjusted by adjusting the voltage difference between the first end of the light-emitting component and the second end of the light-emitting component, thereby solving the following technical issues in the related art: the driving transistor driving the silicon-based OLED to emit light works in the subthreshold region, so the size of the driving transistor needs to be very large, so it cannot be applied to a high-resolution display product, and the size of the storage capacitor cannot be made large, resulting in a that the luminance of the light-emitting component is unstable due to the inability to stably maintain the data voltage.

Figure 6:
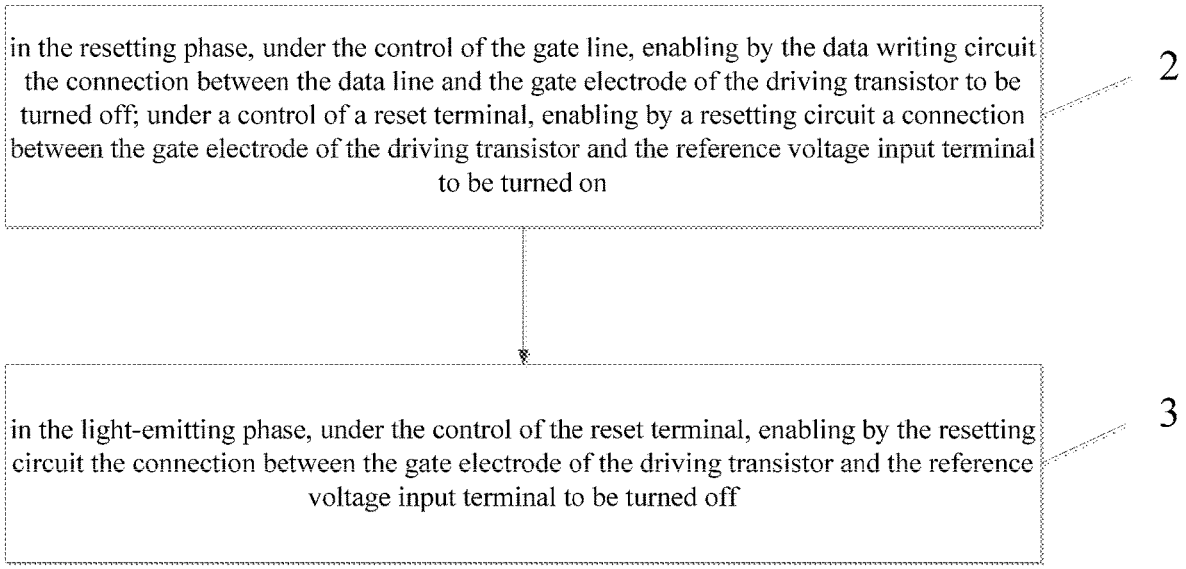
FIG. 6 is a flow chart of a method of driving a pixel unit circuit in some embodiments of the present disclosure.

Optionally, each display period further includes a resetting phase. As shown in FIG. 6, the method further includes: in each display period, Step 2: in the resetting phase, under the control of the gate line, enabling by the data writing circuit the connection between the data line and the gate electrode of the driving transistor to be turned off; under a control of a reset terminal, enabling by a resetting circuit a connection between the gate electrode of the driving transistor and the reference voltage input terminal to be turned on;

Step 3: in the light-emitting phase, under the control of the reset terminal, enabling by the resetting circuit the connection between the gate electrode of the driving transistor and the reference voltage input terminal to be turned off.

Optionally, each display period further includes a resetting phase prior to the light-emitting phase. The driving method of the pixel unit circuit in some embodiments of the present disclosure may further include a resetting step to control the potentials of two ends of the storage capacitor circuit to be equal in the resetting phase, thereby quickly discharging the storage capacitor circuit, ensuring that the image of the previous frame does not affect the image of the next frame. By adjusting the voltage value of reference voltage input terminal, the difference between the potential of the first end of the light-emitting component and the potential of the second end of the light-emitting component in the resetting phase may be smaller than the light-up voltage of the light-emitting component, so that the light-emitting components do not emit light during the resetting phase, and the dynamic image sticking may not occur in the dynamic picture.

Specifically, the reference voltage input terminal is configured to input a reference voltage;

Optionally, a difference between the reference voltage and a threshold voltage of the driving transistor is smaller than a sum value of a low level input by the low-level input terminal and a light-up voltage of the light-emitting component, so as to reduce the voltage difference between the first end and the second end of the light-emitting component in the resetting phase, so that the light-emitting component does not illuminate, ensuring that dynamic image sticking does not occur in the dynamic picture.

Figure 7:
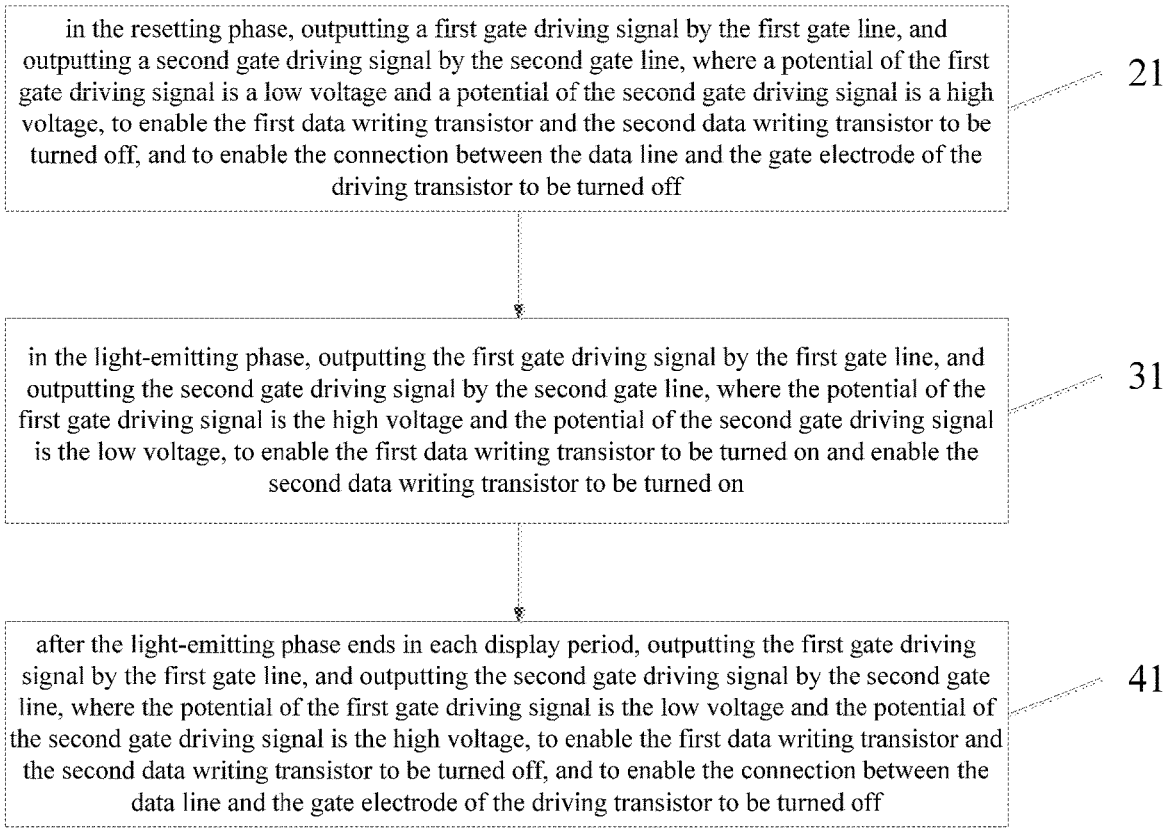
FIG. 7 is a flow chart of a method of driving a pixel unit circuit in some embodiments of the present disclosure.

Specifically, the gate line includes a first gate line and a second gate line, and the data writing circuit includes: a first data writing transistor, where a gate electrode of the first data writing transistor is coupled to the first gate line; a second data writing transistor, where a gate electrode of the second data writing transistor is coupled to the second gate line; the first data writing transistor is an n-type transistor, and the second data writing transistor is a p-type transistor; and when an absolute value of a threshold voltage of the first data writing transistor is equal to an absolute value of a threshold voltage of the second data writing transistor, as shown in FIG. 7, the enabling by the data writing circuit the connection between the data line and the gate electrode of the driving transistor to be turned off in the resetting phase under the control of the gate line, further includes:

Step 21: in the resetting phase, outputting a first gate driving signal by the first gate line, and outputting a second gate driving signal by the second gate line, where a potential of the first gate driving signal is a low voltage and a potential of the second gate driving signal is a high voltage, to enable the first data writing transistor and the second data writing transistor to be turned off, and to enable the connection between the data line and the gate electrode of the driving transistor to be turned off;

as shown in FIG. 7, the enabling by the data writing circuit the connection between the data line and the gate electrode of the driving transistor to be turned on in the light-emitting phase under the control of the gate line, includes:

Step 31: in the light-emitting phase, outputting the first gate driving signal by the first gate line, and outputting the second gate driving signal by the second gate line, where the potential of the first gate driving signal is the high voltage and the potential of the second gate driving signal is the low voltage, to enable the first data writing transistor to be turned on and enable the second data writing transistor to be turned on;

as shown in FIG. 7, the method further includes:

Step 41: after the light-emitting phase ends in each display period, outputting the first gate driving signal by the first gate line, and outputting the second gate driving signal by the second gate line, where the potential of the first gate driving signal is the low voltage and the potential of the second gate driving signal is the high voltage, to enable the first data writing transistor and the second data writing transistor to be turned off, and to enable the connection between the data line and the gate electrode of the driving transistor to be turned off.

Figure 8:
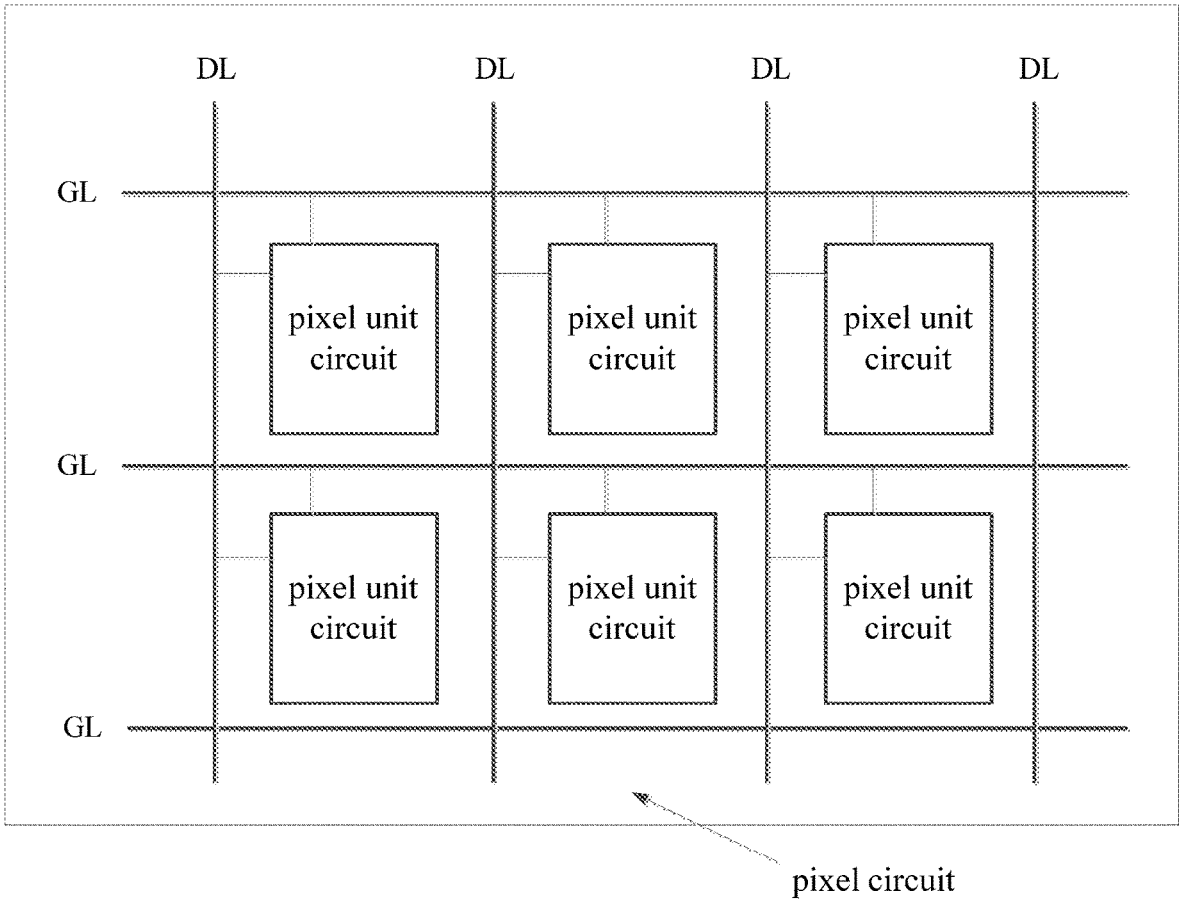
FIG. 8 is a schematic view of a pixel circuit in some embodiments of the present disclosure.

A pixel circuit is further provided in some embodiments of the present disclosure. As shown in FIG. 8, the pixel circuit includes: a plurality of rows of gate lines GLs, a plurality of columns of data lines DLs and a plurality of pixel unit circuits arranged in an array form hereinabove, where the pixel unit circuits in the same row are coupled to the gate line GL in the same row, and the pixel unit circuits in the same column are coupled to the data line DL in the same column.

Figure 9:
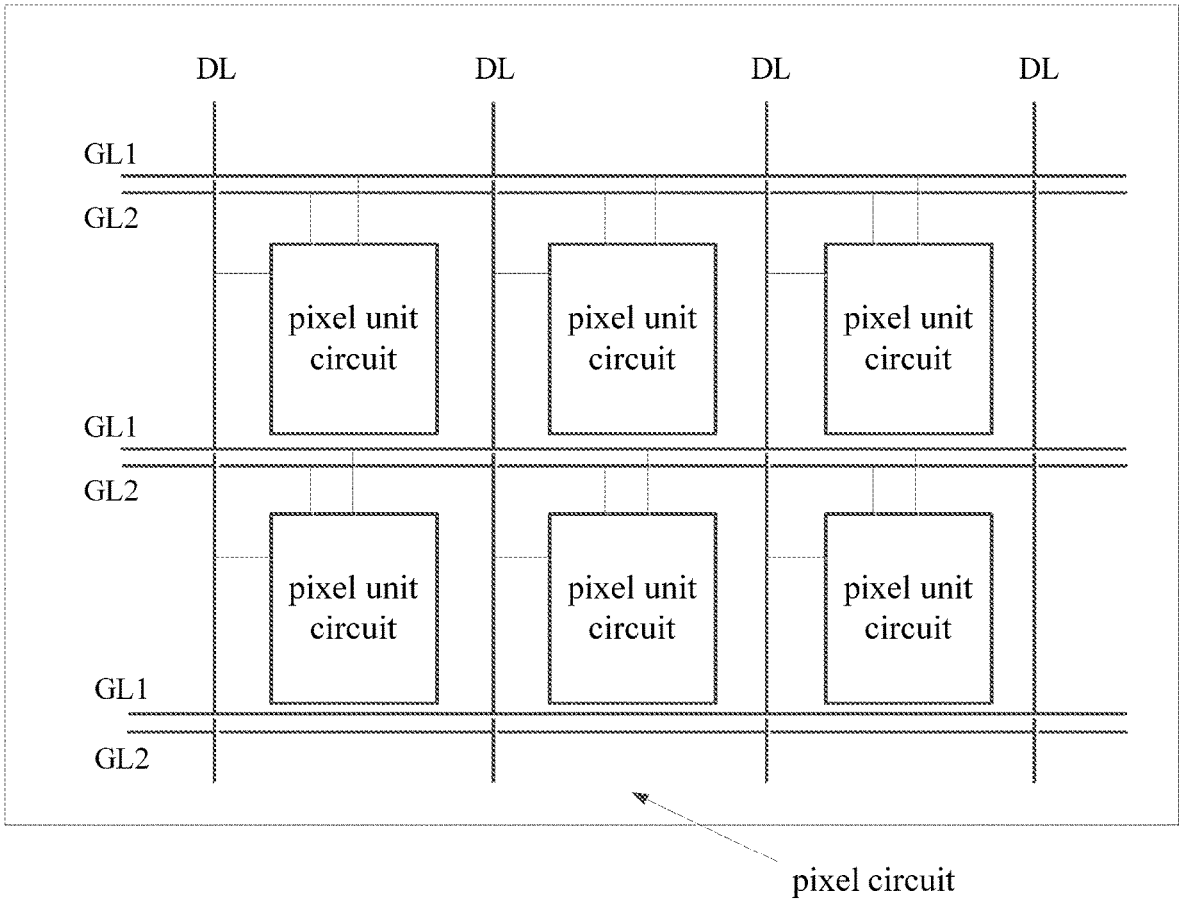
FIG. 9 is a schematic view of a pixel circuit in some embodiments of the present disclosure.

As shown in FIG. 9, in some embodiments of the present disclosure, the gate lines include first gate lines GL1*s* and second gate lines GL2*s*, and the pixel unit circuits in the same row are each coupled to the first gate line GL1 in the same row and the second gate line GL2 in the same row.

It should be noted that "coupled to" in the embodiments of the present disclosure include direct connections and indirect connections implemented via other elements.

Figure 10:
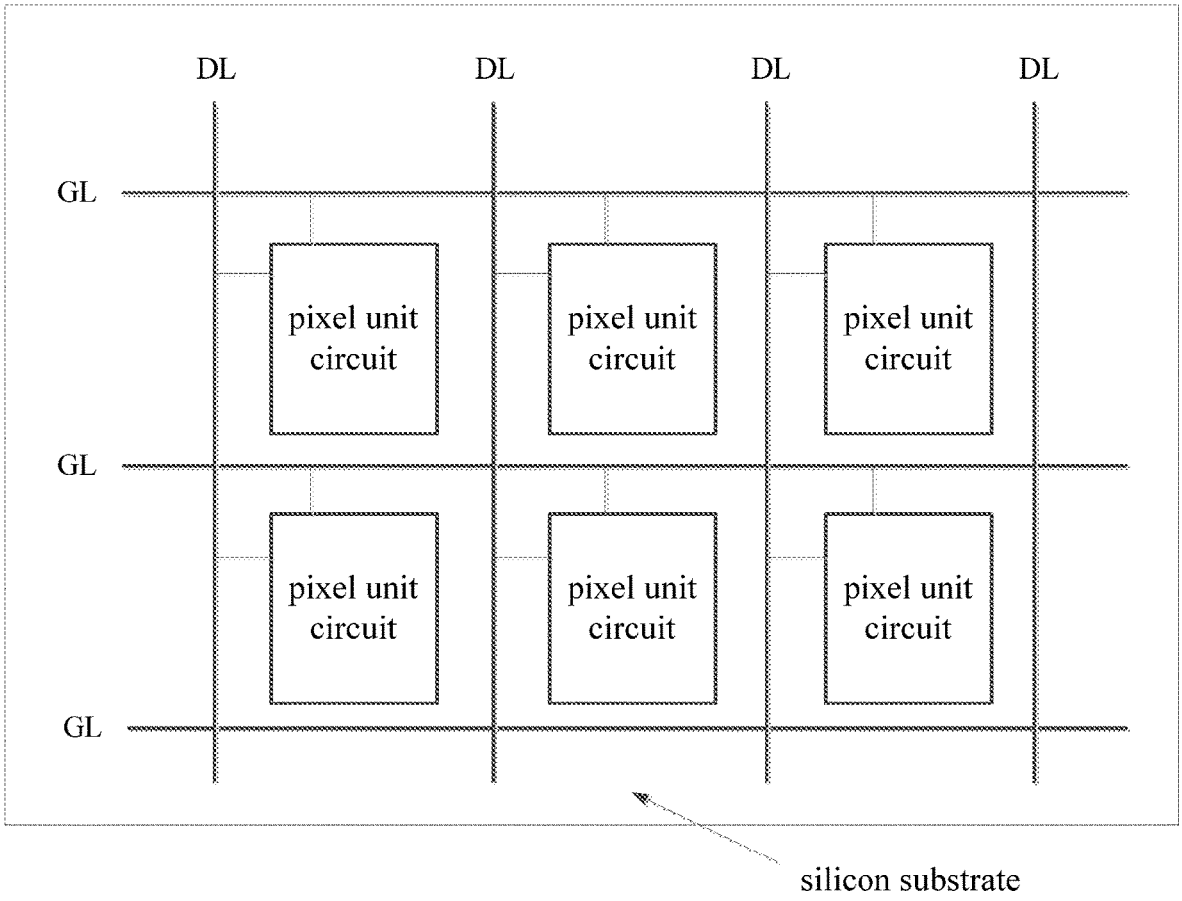
FIG. 10 is a schematic view of a display device in some embodiments of the present disclosure.

A display device is further provided in some embodiments of the present disclosure. As shown in FIG. 10, the display device includes: a plurality of rows of gate lines GLs, a plurality of columns of data lines DLs and a plurality of pixel unit circuits arranged in an array form hereinabove, where the pixel unit circuits in the same row are coupled to the gate line GL in the same row, and the pixel unit circuits in the same column are coupled to the data line DL in the same column.

Optionally, the display device further includes a silicon substrate, where the plurality of rows of gate lines, the plurality of columns of data lines and the plurality of pixel unit circuits are arranged on the silicon substrate.

The above are merely some embodiments of the present disclosure. A person skilled in the art may make further modifications and improvements without departing from the principle of the present disclosure, and these modifications and improvements shall also fall within the scope of the present disclosure.

What is claimed is:

1. A method of driving a pixel unit circuit, wherein the pixel unit circuit comprises:

a light-emitting component, a driving transistor, a data writing circuit and a storage capacitor circuit, wherein a drain electrode of the driving transistor is coupled to a high-level input terminal, a source electrode of the driving transistor is coupled to a first end of the light-emitting component, the driving transistor is an n-type transistor;

the data writing circuit is coupled to a data line, at least one gate line and a gate electrode of the driving transistor, and configured to, under a control of the at least one gate line, enable a connection between the data line and the gate electrode of the driving transistor to be turned on or off;

a first end of the storage capacitor circuit is coupled to the gate electrode of the driving transistor, and a second end of the storage capacitor circuit is coupled to a reference voltage input terminal;

a second end of the light-emitting component is coupled to a low-level input terminal;

a source electrode voltage of the driving transistor varies with a gate electrode potential of the driving transistor;

in a light-emitting phase, under a control of the at least one gate line, enabling by the data writing circuit a connection between the data line and the gate electrode of the driving transistor to be turned on, to enable the driving transistor to work in a constant-current region to drive the light-emitting component to emit light, wherein a source electrode voltage of the driving transistor varies with a gate electrode potential of the driving transistor;

wherein each display period further comprises a resetting phase, the method further comprises:

in the resetting phase, under the control of the at least one gate line, enabling by the data writing circuit the connection between the data line and the gate electrode of the driving transistor to be turned off; under a control of a reset terminal, enabling by a reset circuit a connection between the gate electrode of the driving transistor and the reference voltage input terminal to be turned on;

in the light-emitting phase, under the control of the reset terminal, enabling by the reset circuit the connection between the gate electrode of the driving transistor and the reference voltage input terminal to be turned off;

wherein the at least one gate line comprises a first gate line and a second gate line, and the data writing circuit comprises:

a first data writing transistor, wherein a gate electrode of the first data writing transistor is coupled to the first gate line;

a second data writing transistor, wherein a gate electrode of the second data writing transistor is coupled to the second gate line;

the first data writing transistor is an n-type transistor, and the second data writing transistor is a p-type transistor; and when an absolute value of a threshold voltage of the first data writing transistor is equal to an absolute value of a threshold voltage of the second data writing transistor, the enabling by the data writing circuit the connection between the data line and the gate electrode of the driving transistor to be turned off in the resetting phase under the control of the at least one gate line, further comprises:

outputting a first gate driving signal by the first gate line, and outputting a second gate driving signal by the second gate line, wherein a potential of the first gate driving signal is a low voltage and a potential of the second gate driving signal is a high voltage, to enable the first data writing transistor and the second data writing transistor to be turned off, and to enable the connection between the data line and the gate electrode of the driving transistor to be turned off;

the enabling by the data writing circuit the connection between the data line and the gate electrode of the driving transistor to be turned on in the light-emitting phase under the control of the at least one gate line, comprises:

outputting the first gate driving signal by the first gate line, and outputting the second gate driving signal by the second gate line, wherein the potential of the first gate driving signal is the high voltage and the potential of the second gate driving signal is the low voltage, to enable the first data writing transistor to be turned on and enable the second data writing transistor to be turned on;

the method further comprises: after the light-emitting phase ends in each display period, outputting the first gate driving signal by the first gate line, and outputting the second gate driving signal by the second gate line, wherein the potential of the first gate driving signal is the low voltage and the potential of the second gate driving signal is the high voltage, to enable the first data writing transistor and the second data writing transistor to be turned off, and to enable the connection between the data line and the gate electrode of the driving transistor to be turned off.

2. The method according to claim 1, wherein the reference voltage input terminal is configured to input a reference voltage;

a difference between the reference voltage and a threshold voltage of the driving transistor is smaller than a sum value of a low level input by the low-level input terminal and a light-up voltage of the light-emitting component.

* * * * *